US006739074B2

(12) United States Patent
Trommer

(10) Patent No.: US 6,739,074 B2
(45) Date of Patent: May 25, 2004

(54) TAMPER RESISTANT INSTITUTIONAL SHOE AND METHOD

(76) Inventor: Evan B. Trommer, 1631 W. 2550 South, Ogden, UT (US) 84401

( * ) Notice: Subject to any disclaimer, the term of this patent is extended or adjusted under 35 U.S.C. 154(b) by 18 days.

(21) Appl. No.: 10/282,916

(22) Filed: Oct. 29, 2002

(65) Prior Publication Data

US 2004/0016149 A1 Jan. 29, 2004

Related U.S. Application Data

(60) Provisional application No. 60/398,162, filed on Jul. 23, 2002.

(51) Int. Cl.[7] ..... A43B 13/00

(52) U.S. Cl. ..... 36/1; 36/25 R; 36/103; 36/30 R

(58) Field of Search ..... 36/112, 103, 25 R–30 R

(56) References Cited

U.S. PATENT DOCUMENTS

| | | | | |
|---|---|---|---|---|
| 3,281,939 | A | | 11/1966 | McGinnity |
| 4,158,922 | A | | 6/1979 | Dana, III |
| 4,347,673 | A | | 9/1982 | Svetlik |
| 4,505,055 | A | | 3/1985 | Bergmans |
| 4,766,680 | A | | 8/1988 | Maciel et al. |
| 4,931,773 | A | | 6/1990 | Rosen |
| 5,084,988 | A | | 2/1992 | Berger |
| 5,659,979 | A | | 8/1997 | Sileo |
| 5,775,005 | A | * | 7/1998 | McClelland ..... 36/31 |
| 5,822,885 | A | | 10/1998 | Loverin |
| 6,050,007 | A | | 4/2000 | Angelieri et al. |
| 6,539,646 | B2 | * | 4/2003 | Brooks et al. ..... 36/30 R |
| 2002/0050077 | A1 | * | 5/2002 | Wang et al. ..... 36/28 |
| 2002/0083617 | A1 | | 7/2002 | Tsou et al. |

* cited by examiner

*Primary Examiner*—Ted Kavanaugh
(74) *Attorney, Agent, or Firm*—Thorpe North & Western

(57) ABSTRACT

A tamper resistant institutional shoe and method includes a clear outsole to discourage concealment of contraband in an institutional setting, such as prisons or correctional facilities. The institutional shoe can include an upper shoe and an outsole joined together to form a cavity to receive a user's foot. The outsole can be light transparent in at least a translucent manner. In addition, a colored insert advantageously can be fixedly disposed in the cavity on an upper surface of the outsole. The colored insert can be visible through the outsole so that tampering with the outsole or attempts to conceal contraband can be viewed through the outsole. The colored insert can include a light color to better reflect light through the outsole. A plurality of layers of different material can be disposed in the cavity over the upper surface of the outsole. The plurality of layers is adhered to adjacent layers to resist tampering. At least one of the layers can include a material with an internal strength less than a bond strength of the adhesive so that an attempt to tamper with the layer can result in visible destruction of the layer.

6 Claims, 3 Drawing Sheets

TAMPER RESISTANT INSTITUTIONAL SHOE AND METHOD

Benefit is claimed of U.S. Provisional Patent Application No. 60/398,162, filed Jul. 23, 2002.

BACKGROUND OF THE INVENTION

1. Field of the Invention

The present invention relates generally to institutional footwear or shoes. More particularly, the present invention relates to tamper resistant shoes that discourage concealment of contraband and/or weapons, thus potentially saving lives.

2. Related Art

Many institutions, such as prisons, correctional facilities, asylums, and the like, are charged with incarcerating or otherwise detaining people. In addition, such a charge often requires that the institutions restrict such people from various contraband, including for example, weapons and drugs. It will be appreciated that such people often expend great effort and go to great lengths to obtain and conceal such contraband. Such efforts can include tampering with or modifying personal effects to conceal the contraband. Tampering with or modifying the personal effects can damage the personal effects, requiring the institution to replace the personal effects at great expense to the institution.

Certain laws and/or court rulings also require that incarcerated people be provided with certain basic, personal effects, such as clothing and toiletries. It will be appreciated that these personal effects often can become the subject of tampering or modification, as described above, to conceal contraband. It also will be appreciated that such incarcerated people often have little or no motivation to maintain their personal effects. Thus, these personal effects are often subject to extraordinary wear from lack of care, abuse, and tampering. Because institutions are required to provide these personal effects, they are required to replace the worn, abused and/or modified personal effects, often at great expense to the institution.

In addition, it will be appreciated that some contraband, such as concealed weapons, can be used on corrections officers or other incarcerated persons.

SUMMARY OF THE INVENTION

It has been recognized that it would be advantageous to develop a method and shoe for institutional use that resists tampering, abuse and wear to reduce replacement costs. In addition, it has been recognized that it would be advantageous to develop a shoe that resists concealment of contraband, such as weapons, to provide additional safety to corrections officers and other incarcerated persons.

The invention provides a tamper resistant institutional shoe to discourage concealment of contraband in an institutional setting, such as prisons or correctional facilities. The institutional shoe can include an upper shoe and an outsole joined together to form a cavity to receive a user's foot with the outsole disposed under the user's foot and the upper shoe extending over the user's foot. The outsole advantageously can be light transparent in at least a translucent manner. In addition, a colored insert advantageously can be fixedly disposed in the cavity on an upper surface of the outsole. The colored insert can be visible through the outsole so that tampering with the outsole or attempts to conceal contraband can be viewed through the outsole. Therefore, contraband, such as weapons, cannot be concealed within the outsole, potentially saving the lives of corrections officers and other incarcerated persons. The colored insert can include a light color to better reflect light through the outsole.

In accordance with a more detailed aspect of the present invention, a rigid board can be disposed in the cavity over the upper surface of the outsole and over the colored insert to resist access to the colored insert and the outsole.

In accordance with another more detailed aspect of the present invention, a plurality of layers of different material can be disposed in the cavity over the upper surface of the outsole. The plurality of layers is adhered to adjacent layers to resist tampering. At least one of the layers can include a material with an internal strength less than a bond strength of the adhesive. Thus, an attempt to tamper with the layer can result in visible destruction of the layer.

In accordance with another more detailed aspect of the present invention, indicia can be disposed between the insert and the outsole and can be visible through the outsole. The indicia can include an identification of a correctional facility.

In accordance with another more detailed aspect of the present invention, the institutional shoe can be provided without any metal or rigid plastic components. Such components might be used as weapons, and can be detected by metal detectors, resulting in false alarms.

A method for discouraging concealment of contraband in an institutional setting can includes providing people confined to an institution with shoes as described above. The shoes can be inspected for evidence of tampering or for contraband concealed therein by viewing the outsole and looking through the outsole.

In accordance with a more detailed aspect of the present invention, the shoes can be inspected without removing the shoes from the feet of the people wearing the shoes. Alternatively, the shoes can be removed and inspected both inside and out. The inside of the shoes can be inspected for evidence of tampering.

In addition, the lack of metal components allows the shoes to clear metal detectors, thus saving processing time.

Additional features and advantages of the invention will be apparent from the detailed description which follows, taken in conjunction with the accompanying drawings, which together illustrate, by way of example, features of the invention.

DETAILED DESCRIPTION

Figure 1:
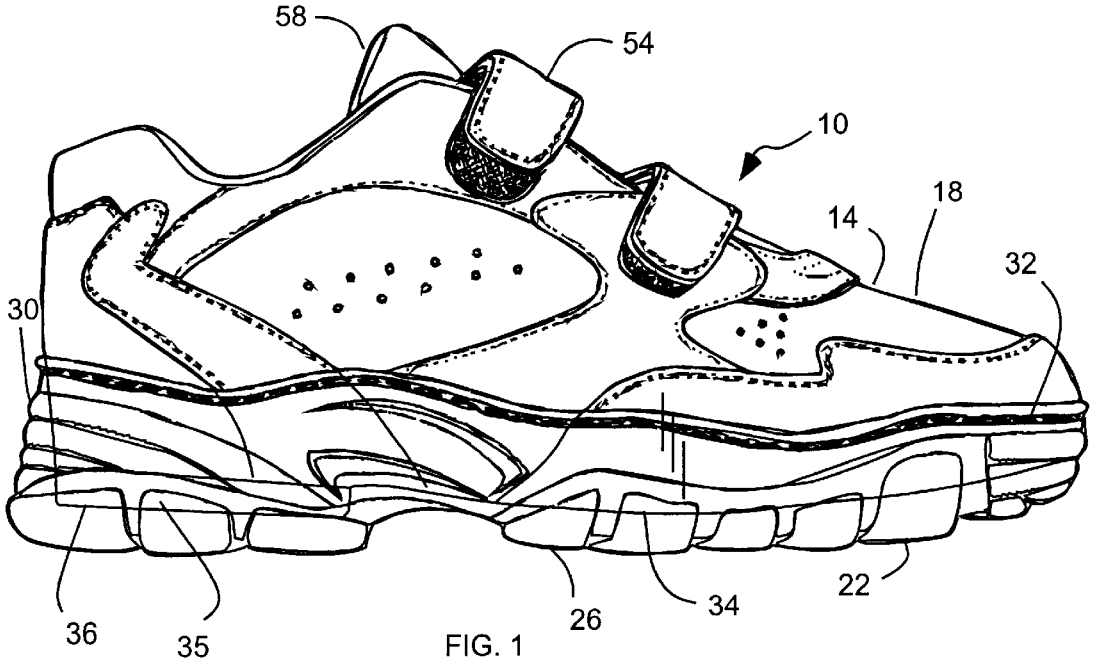
FIG. 1 is a side view of an institutional shoe in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
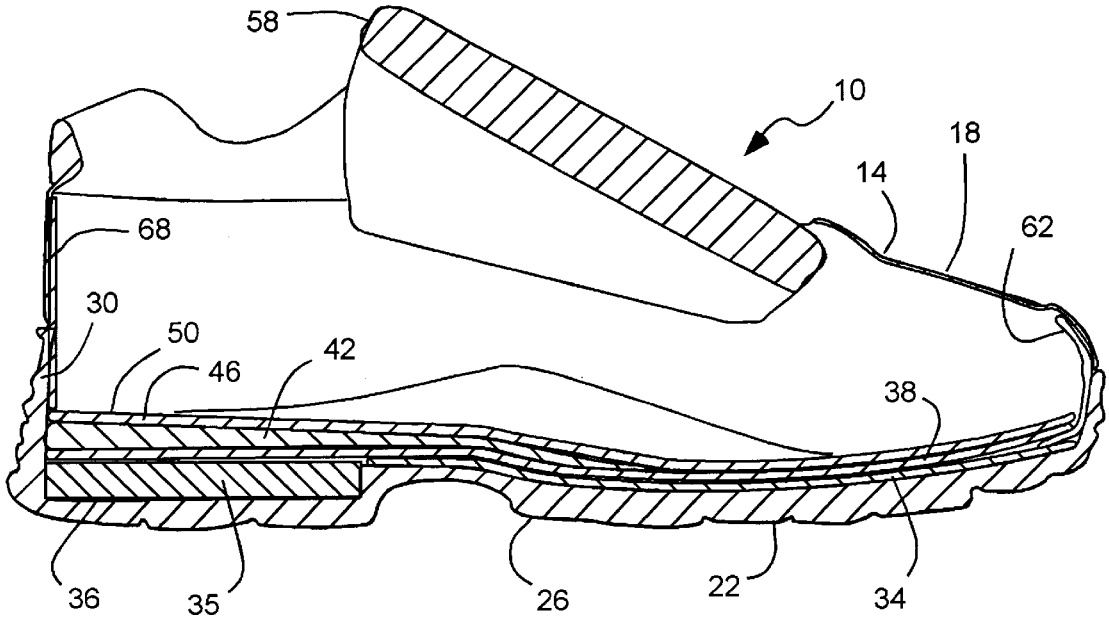
FIG. 2 is a cross-sectional side view of the institutional shoe of FIG. 1.
Figure 3:
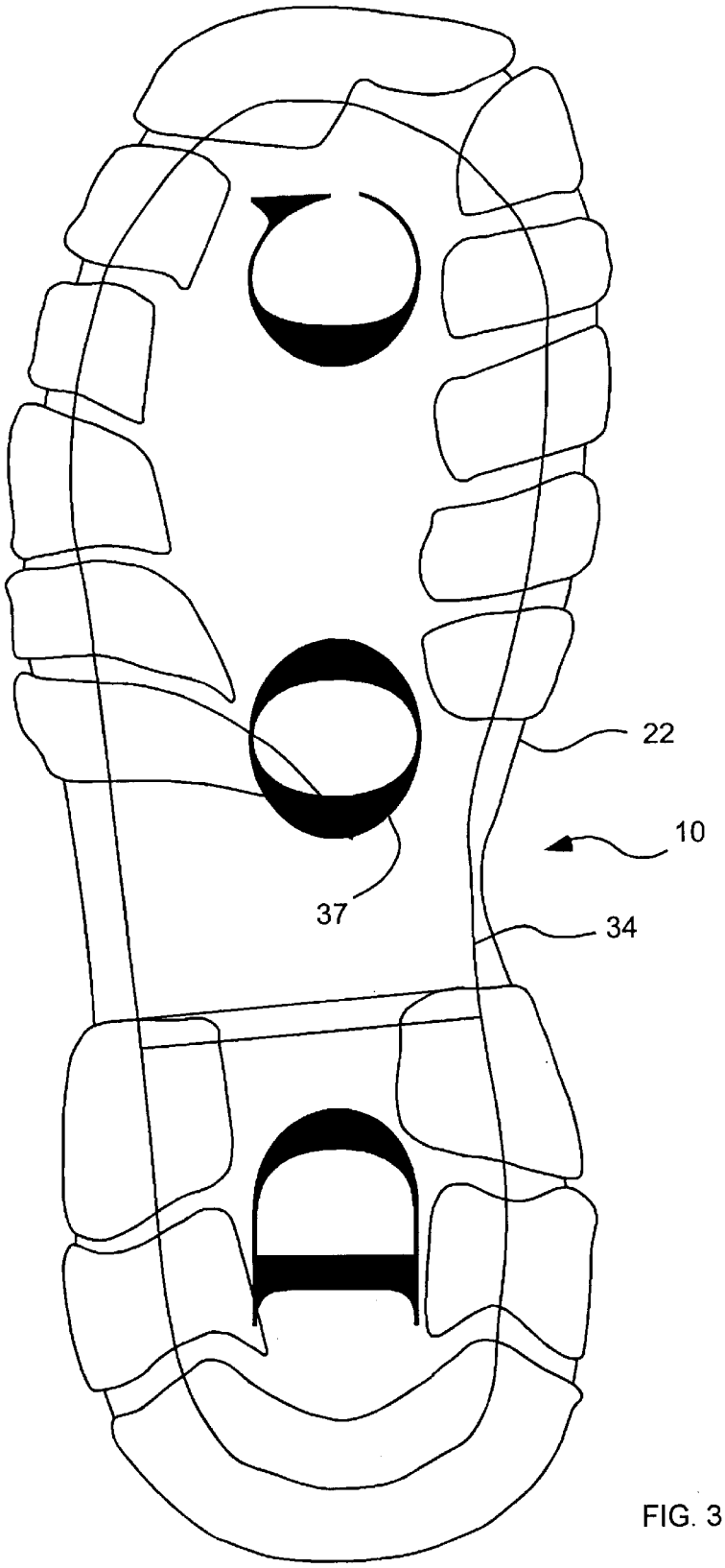
FIG. 3 is a bottom view of the institutional shoe of FIG. 1.
Figure 4:
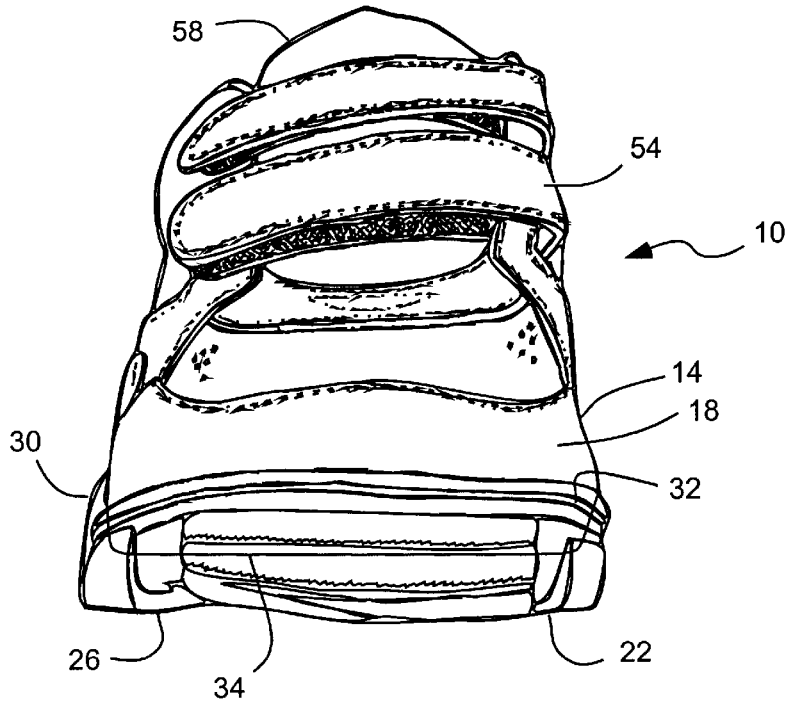
FIG. 4 is a front view of the institutional shoe of FIG. 1.
Figure 5:
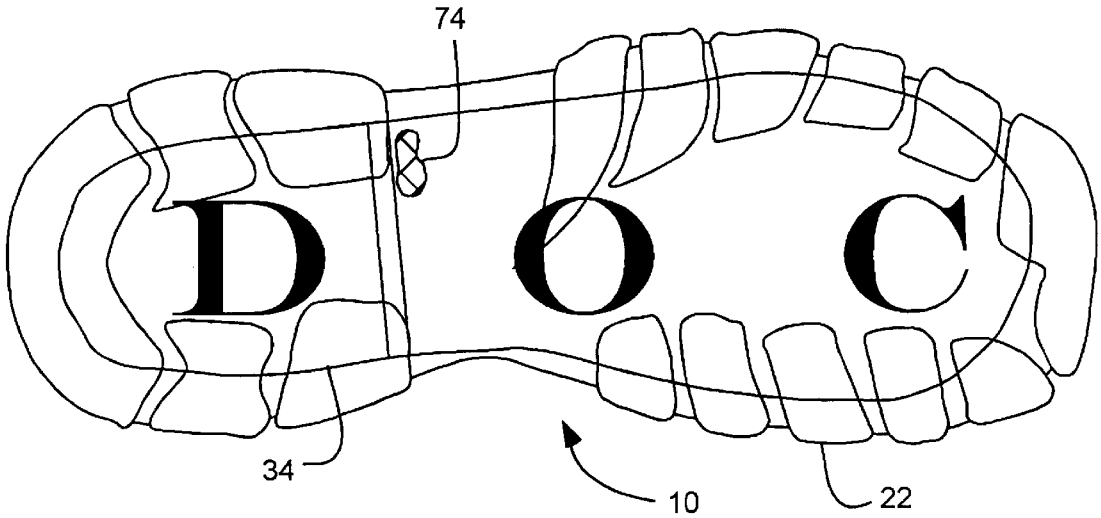
FIG. 5 is a schematic bottom view of the institutional shoe of FIG. 1.

As illustrated in FIGS. 1–5, an institutional shoe, indicated generally at 10, in accordance with the present invention is shown for discouraging and resisting tampering, increasing durability, discouraging concealment of contraband, and revealing such contraband. Institutions, such as prisons, correctional facilities, and asylums, are examples of fields that can benefit from the use of such a shoe. Such a shoe can be used with prisoners, incarcerated people, committed people, etc.

As described above, such incarcerated people often have little or no motivation to maintain their personal effects, such as shoes. Thus, these personal effects, including shoes, are often subject to extraordinary wear from lack of care, abuse, and tampering. Such incarcerated people may destroy their shoes for various reasons, including mental or behavior disorders, etc. Because institutions are required to provide shoes, they are required to replace the worn, abused and/or modified shoes, often at great expense to the institution. Therefore, it has been recognized that it would be advantageous to provide an institutional shoe that is durable, and resists destructive behavior.

In addition, as described above, such incarcerated people often expend great effort and go to great lengths to obtain and conceal contraband, such as weapons or drugs. Such efforts can include tampering with or modifying shoes to conceal the contraband. Tampering with or modifying the shoes can damage the shoes, requiring the institution to replace the shoes at great expense to the institution. In addition, concealed contraband can harm both those persons who are incarcerated, and institutional employees, such as corrections officers, etc. Such incarcerated people may hollow out the sole of their shoe to hide contraband. Therefore, it has been recognized that it would be advantageous to provide an institutional shoe that discourages tampering and concealment of contraband, and that reveals such tampering and concealment.

The institutional shoe 10 can include an enclosure 14 sized and shaped to fit around the user's foot. The shoe 10 or enclosure 14 can include an upper shoe or upper portion 18 and an outsole or lower portion 22. The outsole 22 advantageously is clear or light transparent in at least a translucent manner to enable visible inspection through the outsole 22. The transparent outsole 22 can discourage tampering with the outsole or concealment of contraband within the outsole or shoe because such tampering or concealment can be viewed or discovered through the clear outsole. For example, any cavity formed in the outsole, or between the outsole and the interior of the shoe, advantageously will be visible through the transparent outsole. Thus, tampering with the shoe or outsole to conceal contraband can be discouraged, increasing the likelihood that the shoe will not be tampered with or destroyed, and reducing the costs to institutions of replacing such shoes.

The outsole 22 or lower portion can be sized and shaped to fit a bottom of the user's foot. The upper shoe 18 or upper portion can be sized and shaped to fit a top of the user's foot. The upper shoe 18 and outsole 22 can be separate pieces secured or attached together. Alternatively, the upper and outsole can be integrally formed as a unitary, monolithic enclosure. It will be appreciated that the upper shoe 18 also can be transparent.

The upper shoe 18 can be formed of a durable material, such as leather. The leather can include a PVC foam with a backing cloth. Alternatively, the upper can be formed of canvas, plastic, etc. The upper shoe 18 can be formed of various portions sewn together to form the upper shoe, as is known in the art. In addition, the upper shoe 18 can be predominantly a neutral color, such as black or white, so as not to be compatible with gang colors. The color black also resists showing dirt.

The outsole 22 can include a generally horizontal, lower portion 26 sized and shaped to fit a bottom of the user's foot, and a generally vertical perimeter or side and end portion 30 extending upwardly from a perimeter of the lower portion to fit the sides of the user's foot. The lower and side portions 26 and 30 can be integrally formed as a unitary, monolithic outsole. In addition, both the lower and side portions 26 and 30 can be clear or translucent, as described above. Thus, bottom, side and end portions of the outsole 22 can be inspected. In one aspect, the outsole 22 advantageously is solid, or formed of a solid material. Thus, the outsole 22 can be void of substantial cavities in which contraband can be disposed. A single cavity can be formed in the outsole at a heel location to provide for a cushion. In addition, a lower surface of the outsole 22 can be contoured and/or textured to provide traction.

As described above, the upper shoe 18 and outsole 22 can be attached together. The side portion 26 of the outsole and the upper 18 can be attached together. In one aspect, the side portion 30 and upper shoe 18 can be sewn or stitched together along a seam 32 extending around an entire periphery of the show or outsole. Such a sewn or stitched seam is believed to be stronger, and thus the shoe can be more durable.

The outsole 22 can be formed of a material that is both durable and clear, transparent or translucent. For example, the outsole can be formed from clear rubber-NBR, Neoprene, or natural rubber; clear TPR-thermoplastic rubber; or synthetic rubber, such as Dupont brand "Engage". Such materials have been found to provide the desired characteristics of both transparency and durability. In addition, such material has been found to provide a frictional, non-slip surface.

A sheet or insert 34 advantageously can be disposed in the shoe 10, on an upper surface of the outsole 22. In one aspect, the insert 34 is colored, such as white or light-colored, to better reflect light and facilitate viewing through the outsole. The light-colored sheet or insert 34 provides a light-colored background or backdrop to the clear outsole 22 to facilitate visibility through the outsole, and highlight any contraband concealed in or behind the outsole. The sheet or insert 34 can be glued or adhered to the upper surface of the outsole 22 to resist or prevent removal of the sheet or insert from the outsole. The light-colored sheet or insert 34 can include an EVA sheet or EVA foam or compound. The EVA foam or compound 35 can be disposed in the single cavity 36 at the heel. Thus, the EVA foam or compound provides for both cushion and a light-colored backdrop. The EVA sheet can be disposed over the upper surface of the outsole at an arch and toe location.

Indicia 37 can be disposed behind the outsole 22, between the outsole 22 and the light-colored sheet or insert 34. The indicia 37 can include identifying marks or names of the institution, logos, instructions, etc. The indicia can be printed on the upper surface of the outsole 22, or the lower surface of the light-colored sheet or insert 34. Positioning the indicia behind the clear outsole allows the indicia to be visible while resisting tampering or altercation.

A generally rigid, inner board 38 can be disposed in the shoe 10, over the outsole 22 and light-colored sheet or insert 34. The board 38 provides support and resists access to the outsole 22, insert 34, and EVA foam or compound, and thus resists alteration or tampering, and concealment of contraband. The board 38 can be glued or adhered to the light-colored sheet or insert 34 to resist tampering or removal. The board 38 can be formed of a rigid material, such as Texon.

An insole lining 42 can be disposed on or over the board 38. The insole lining 42 can include a cushioning material, such as latex, to provide support and comfort. Again, the insole lining 42 can be glued or adhered to the board 38 to resist removal. An insole 46 can be disposed on or over the insole lining 42 and/or board 38. The insole 46 can include a cushioning material, such as EVA, to provide support and comfort. The insole 46 can be glued or adhered to the insole lining 42 and/or the board 38 to resist removal. A lining 50 can be disposed on or over the insole 46 for durability. The lining 50 can include a durable material, such as canvas. The lining 50 can be glued or adhered to the lining to resist removal.

The various layers can be glued or adhered with an adhesive. Adhering the various layers together resists the layers from being separated. In addition, the selection of the materials, combined with the glue, causes the materials to come apart, or break apart, when excessive force is applied. Thus, attempts to separate the layers from one another generally result in destruction of the layers without providing concealment.

It will be appreciated that the various inner layers or inserts described above are exemplary, and that additional or fewer layers can be included, or that the layers can be rearranged. It is believed, however, that the above described configuration provides a balance of comfort, durability, and resistance to concealment or tampering.

The upper 18 can include a slip or gap, as is known in the art, that allows opposite sides of the upper to be separated as the shoe is put on or removed. Straps 54 can have one end permanently attached to one side of the upper, inserted through holes in the other side, foldable back to the one end, and releasably secured to the one end to releasably and adjustably secure the opposite sides of the upper while being worn. A releasable fastener, such as hook-and-loop type fasteners, can be used to releasably secure the free end of the straps to the upper. Permanently attaching the straps to the upper resists the straps from being removed from the shoe and lost or removed for other purposes. A tongue 58 can be disposed and secured in the shoe and located at the slip or gap.

A toe guard or bumper 62 can be disposed in the shoe at a toe location to provide support. The toe guard or bumper 62 can be arcuate and can extend around the toe location. The toe guard or bumper 62 can be formed of more rigid material. Similarly, a back counter 66 can be disposed in the shoe at a heel location to provide support. The back counter 66 can be arcuate and can extend around the heel location. The back counter can be formed of a more rigid material.

The shoe 10 can be configured as a tennis shoe or sneaker. Thus, the shoe 10 can be relatively flexible, and capable of bending during use. The materials used for both the upper and outsole, as well as the interior layers, can thus be relatively flexible. It is of course understood that the shoe can be configured in other styles or designs, such as a more formal dress shoe or a more casual leisure shoe.

A method for discouraging concealment of contraband in an institutional setting includes providing incarcerated people, or people confined to an institution, with institutional shoes 10, as described above. The institutional shoes 10 are inspected for evidence of tampering, or for contraband concealed therein, by viewing the outsole 22 and looking through the outsole. The outsole can be inspected by looking through the outsole to the colored insert. For example, referring to FIG. 5, contraband or tampering, indicated at 74, can be viewed through the clear outsole 22. The shoes 10 can be inspected without requiring the incarcerated people to remove their shoes. Thus, inspections can be performed quickly. In addition, the clear nature of the outsoles 22 can discourage the incarcerated people from even attempting to alter or tamper with their shoes. It is believed that such discouragement can result in the need for less shoe replacement by the institution. Such inspections can be performed by institutional employees or personnel, such as corrections officers. In addition, such inspections can be carried out regularly or randomly.

The inspection also can include the inside of the shoe. Thus, the shoes can be removed and inspected. As described above, the various layers resist tampering, and can break apart during such tampering to reveal such tampering. Thus, the interior of the shoe can be inspected for evidence of tampering.

In addition, the shoes can be worn through a metal detector during processing of inmates. Because the shoes can be provided without any metal components, the shoes can clear the metal detectors, resulting in quicker processing of inmates. It will be appreciated that any metal components in a shoe may set off a metal detector, requiring further inspection of the shoes, and thus greater processing time.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A method for discouraging concealment of contraband in an institutional setting, comprising the steps of:

a) providing people confined to an institution with shoes having an outsole that is light transparent in at least a translucent manner; and b) inspecting the shoes for evidence of tampering or for contraband concealed therein by viewing the outsole and looking through the outsole.

2. A method in accordance with claim 1, wherein the step of providing shoes further includes providing shoes with a colored insert fixedly disposed on an inner surface of the outsole; and wherein the step of inspecting the shoes includes looking through the outsole to the colored insert.

3. A method in accordance with claim 1, wherein the step of providing shoes further includes providing shoes with various layers adhered with adhesive to adjacent layers; at least one of the various layers including a material with an internal strength less than a bond strength of the adhesive.

4. A method in accordance with claim 1, wherein the step of inspecting the shoes further includes inspecting both an outside and an inside of the shoes without removing the shoes from feet of the people.

5. A method in accordance with claim 1, further comprising the step of:

a) removing the shoes from the people; and b) inspecting an inside of the shoes for evidence of tampering or for contraband concealed therein.

6. A method in accordance with claim 1, wherein the step of providing shoes further includes providing shoes to inmates of a correctional facility.

* * * * *